United States Patent [19]

Chen

[11] Patent Number: 4,485,522

[45] Date of Patent: Dec. 4, 1984

[54] DOOR-CLOSING HINGE HAVING A SPRING AND PIN MECHANISM

[76] Inventor: Youn-Long Chen, No. 182, Kae Shyuan 2nd Rd., Kaohsiung, Taiwan, 800

[21] Appl. No.: 413,494

[22] Filed: Aug. 31, 1982

[51] Int. Cl.[3] ..... E05F 3/20

[52] U.S. Cl. ..... 16/54; 16/58; 16/303; 16/307; 16/DIG. 9

[58] Field of Search ..... 16/50, 54, 58, 68, 75, 16/76, 82, 303, 307, 308, DIG. 9, DIG. 10, DIG. 36

[56] References Cited

U.S. PATENT DOCUMENTS

| | | | |
|---|---|---|---|
| 424,613 | 4/1890 | Morris | 16/54 |
| 424,614 | 4/1890 | Morris | 16/54 |
| 491,898 | 2/1893 | Lowe | 16/54 |
| 973,680 | 10/1910 | Marksch | 16/54 |
| 1,281,774 | 10/1918 | Franckaerts | 16/54 |
| 1,927,778 | 9/1933 | Hirakawa | 16/54 |
| 3,074,101 | 1/1963 | Hideyoshi | 16/DIG. 9 X |

FOREIGN PATENT DOCUMENTS

| | | | |
|---|---|---|---|
| 705922 | 3/1931 | France | 16/50 |

*Primary Examiner*—Fred A. Silverberg

*Attorney, Agent, or Firm*—Robert E. Burns; Emmanuel J. Lobato; Bruce L. Adams

[57] ABSTRACT

A door-closing hinge comprising an upper barrel with a wing secured to the door and an aligned lower barrel with a wing secured to the door frame. A bolt rotatable in the lower barrel has a non-circular upper end fitting in a non-circular opening in the upper barrel and a lower stem portion of smaller diameter which extends to the lower end of the lower barrel and has in its lower end a central conical depression engaged by a pivot pin in the lower end of the lower barrel. At the upper end of the lower barrel there is a ball bearing between a threaded collar screwed into the upper end of the lower barrel and a washer on the bolt. A sleeve surrounding the bolt has inner pins slidably received in helical grooves in the bolt and outer pins slidably received in longitudinal grooves in the inner surface of the lower barrel so that when the door is swung from closed position toward open position the sleeve is moved upwardly against the force of a spring which tends to return the door to closed position. The lower barrel is filled with oil which acts hydraulically to control the rate of closing.

7 Claims, 7 Drawing Figures

DOOR-CLOSING HINGE HAVING A SPRING AND PIN MECHANISM

BRIEF SUMMARY OF THE INVENTION

An improved structure of door-closing hinges, specifically it means to have one mechanical entity embodied into another mechanical entity complete with simple transmission units and relevant hydraulical system therein to help achieve a joint working performance altogether, characteristic in the ability to set a door provided accordingly to open and reset it to closed state thereafter automatically.

BACKGROUND OF THE INVENTION

A study of existent self-resettable door hinges or so-called door closers leads to the conclusion that as regards one type of hydraulical automatic door closer, it comprises a hydraulic system and a transmission lever to be installed to the top of the door and to the top of the door frame respectively, such a door closer will indeed achieve self-resetting effects for the door so provided, but its cost is rather high and the fitting is not easily done, as is often the case, besides, it calls for a rather large space and will have to be furnished with a hinge set before other fixture components can be fitted, so to speak, for such kind of hinged door closer it is a must to have three individual units prepared in order for fitting at three individual positions altogether before the automatical self-resetting performance of the door so provided can be expected, such a device is therefore regarded as a troublesome one, as regards another model of automatic hinge that is provided with screws and helical grooves and counterparts of these are also provided on the door involved of which transmission is derived from the gravity of the door as it is being pushed to open to give resetting strains to the door as exerted with respect to the helical grooves, the transmission principle for this door hinge set is simple enough, with little space requirements, still, it is not convenient for fitting, and by far not compatible for use with ordinary or regular doors, as prerequisite for application of such a door hinge is that the door itself be specifically made to accommodate fitting therewith to serve the purpose it is designed to serve; as regards still another kind of automatic self-resetting door hinge, for which transmission is derived from two-way screws and the strains of springs as parts thereof and other specifically devised components under the principle of applied mechanics, it is regrettable to find out that the resetting speed is not so regular or uniform and the strength of the springs can hardly be adjusted to a condition that is just right, what with a higher production costs, it is therefore not so recommendable for economical and performance reasons alike.

SUMMARY OF THE INVENTION

The present invention, therefore, is intended of overcome all the shortcomings due to existing and prevalent door hinges such as those cited above and through time and again of a series of rigidly taken experiments, as an ideally useful structure of automatic hinge, of which the unique self-resetting performance is made possible by the design of the transmission components and the associated hydraulic system.

The present invention is chiefly intended to provide an improved structure of automatic hinge, is substance, it is executed to have a sleeving as provided on an individual unit coupled to the transmission lever as provided on the sleeving of another transmission mechanism, transmission is obtained by the transmission mechanism to give an improved, that is to say, a better resetting performance of the automatic hinges hitherto known to have been put to commercial distributions together with hydraulic systems provided therein.

A further objective of the present invention is to provide for a self-resetting, improved structure of automatic hinges, whereof the sleeving, as mentioned earlier, is to be fitted unto the door in the first place whereas another transmission cylinder is to be installed to the door pivot, and finally the door fitted with the sleeving is to be moved about to get coupled to the transmission mechanism as established unto the door pivot to accomplish the overall assemblage.

Another objective of the present invention is to provide for an improved self-resetting automatic hinge, characteristic in that when a door so provided is pushed to open the sleeving as mentioned earlier will serve to drive the transmission lever, a part of the transmission mechanism, to rotation, whereupon blocks will be lifted up to bring pressures to bear on the springs, the rotation moment will subside to lend to resetting in an easy manner due to the unique design that characterizes the transmission lever, in the meantime, whilst the door is in the process of resetting, the hydraulic system in the cylinder is schemed to be such that resetting of the door be accomplished in a slow but sure manner.

Still another objective of the present invention is to provide for an improved self-resetting automatic hinge as covered above, characteristic in that the transmission lever is designed to shape like a square rod on the upper half thereof, meant to facilitate coupling with the sleeving set as mentioned earlier, and that the lower half, that is, the lower tip of the transmission lever is furnished with two-way helical grooves to accommodate let-in insertion of an inner pin as provided in the blocks so as to facilitate vertical up-and-down movement of the blocks whilst the transmission rotation is in action.

Still another objective of the present invention is to provide for an elliptical rod otherwise designed for fitting unto the top of the transmission lever with a view to accomplish all of the foregoing objectives, characteristic in that the tip front of such an elliptical rod is executed round and machined into two flat surfaces whereas other faces thereabout are treated arc-like, as shown in FIG. 6.

Still another objective of the present invention is to have the tip front of the elliptical rod as related to above designed to slant for 5 degrees in the direction in which the door is to be reset to closure with respect to the lengthwise direction of the door in order that the door, once installed with the present invention, will automatically pull further to a secured closure as the door is in the action of being reset after an attempt to open the door is terminated.

Still another objective of the present invention is to have the lower end as extended from the terminal tip of the transmission lever as related to above designed to take a round profile, and that the interior of the lever designed to serve to contain the circuitry of the hydraulic systems.

Still another objective of the present invention is to provide for an improved self-resetting hinge characteristic in the provision of two tiny holes in the midst of the transmission lever as related to above, and that such a transmission lever is hollow, in order that the grease lubricants as stored in the cylinder mechanism will shuttle through such tiny holes to pass to the center of the transmission lever whenever a transmission is in action.

Still another objective of the present invention is to provide for the blocks as covered in the foregoing paragraphs, designed to be hollow rings with a round hole provided at the bottom thereof and complete with pins on both the outer and inner rims thereof, the inner pins are to be inserted in the two-way helical grooves as provided in the transmission lever whereas the outer pins are to be engaged to the channels as provided on the inner side of the cylinder.

Still another objective of the present invention is to provide a means to have the bottom of last mentioned blocks, or better referred to as slides, attached to a piston and have the said bottom locked with screws, and that the round hole as provided at the middle of the slide bottom is pierced by a rod stem extending from the lower terminal of the transmission lever, that said piston is additionally furnished with two small holes as part of the circuit passage of the hydraulic system of the present invention.

Still another objective of the present invention is to provide an improved self-resetting hinge structure whereof the cylinder casing is fed in with grease lubricants to serve the hydraulic system, and that both the upper and the lower ends of the said cylinder casing are locked with screws, and such that it is made possible to adjust the output of the oil to be released from the oil port as provided at the lower end of the transmission lever with respect to the middle point of the screw as provided on the lower end of the cylinder casing, specifically, adjustment to enlarge the oil output will serve to expedite the resetting of the door.

Still another objective of the present invention is that a bearing is provided in the central concave ring of the screw as provided on the bottom side of the annular ring that is a part of the transmission lever, the bearing is set to project out of the surface of the screw so as to be exposed to oppression by the annular ring as provided on top of the transmission lever due to the gravity of the sleeving that is fitted to the door, so that abrasion hindrances can be reduced as the door is set to rotation whilst it is being pushed to open and to recover to closure thereafter of its own accord.

Still another objective of the present invention is to provide a self-resetting, improved hinge structure characteristic in that the members of the hinge body and the cylinder section thereof can be produced by means of molding ejections, to be later sawn into unitary pieces thus achieving an expeditious production processing at reduced costs and man power labors.

BRIEF DESCRIPTION OF DRAWINGS

What follows is a further attempt to describe the present invention in terms of its structural logic and operational features in further detail with respect to the attached drawings.

DESCRIPTION OF PREFERRED EMBODIMENT

Figure 1:
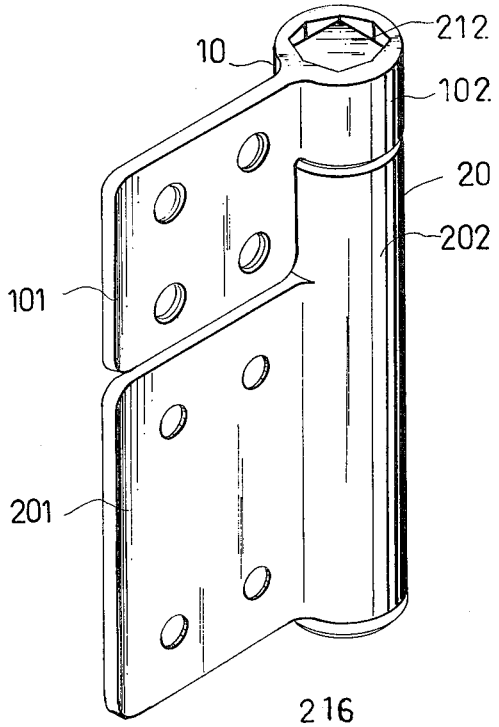
FIG. 1 is a perspective view of a self-closing door hinge in accordance with the present invention.
Figure 2:
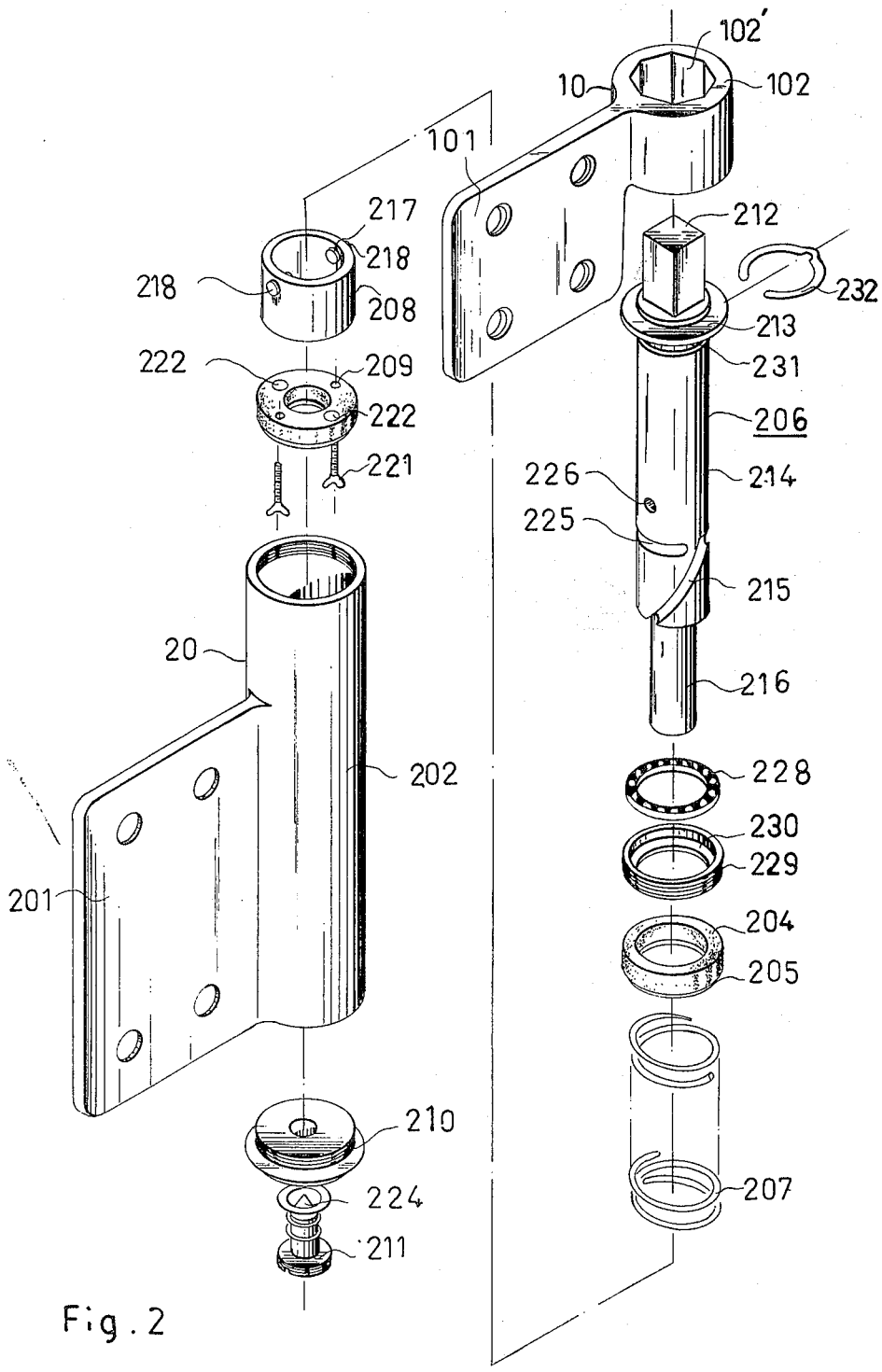
FIG. 2 is a three-dimensional exploded view of the hinge.

Referring to FIG. 1 and FIG. 2, it is seen that a self-closing door hinge in accordance with the present invention is composed of a one piece sleeving 10 that is to be fixed to the door and a cylinder 20 that is to be fitted unto the door frame, the sleeving 10 includes such components as the fixing wing 101, sleeve column 102, the port to the sleeve column 102', whereas the cylinder 20 covers a fix plate 201, and a cylinder body 202, in the cylinder body 202 there is provided a transmission system including an iron piece 205, screws 229, transmission lever 206, springs 207, sliding blocks or sleeves 208, piston 209, screws 210, adjusting bolt 211, all of these being adhered to the oil-proofing ring 204 and the bottom of the oil-proofing ring 204.

Figure 6:
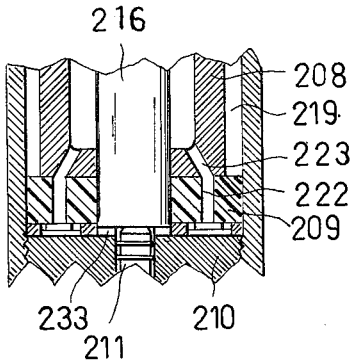
FIG. 6 is a partial longitudinal sectional view along line C—C in FIG. 4.
Figure 5:
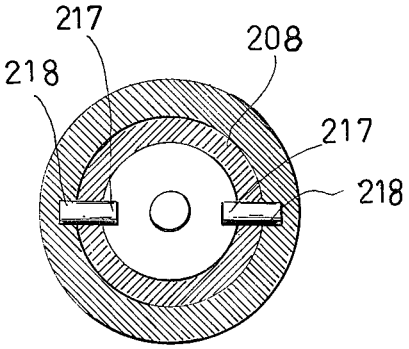
FIG. 5 is a cross-sectional view along line B—B in FIG. 3.
Figure 3:
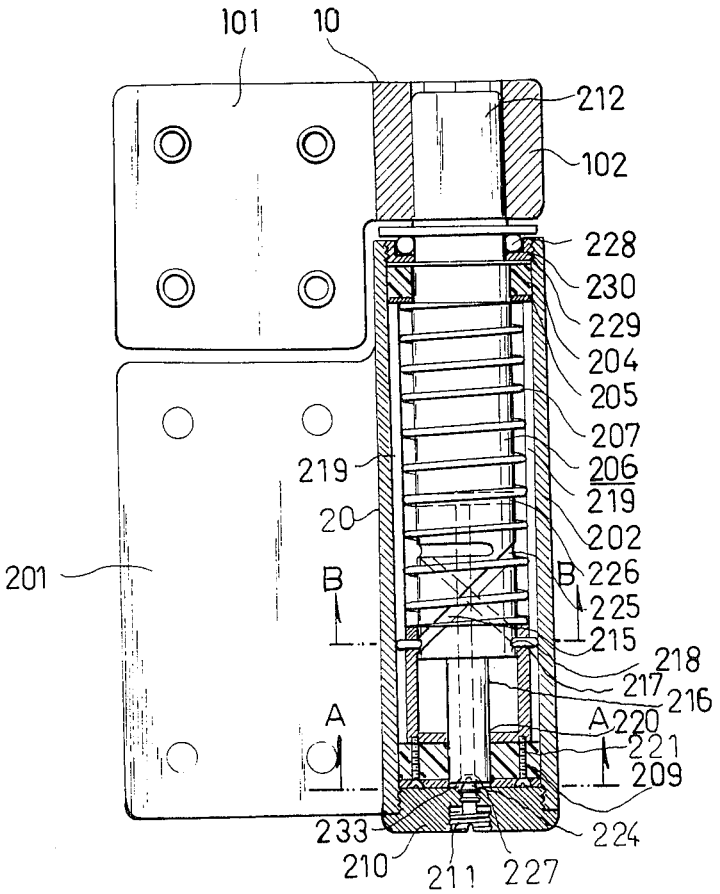
FIG. 3 is an elevational view partially in section of the hinge.
Figure 4:
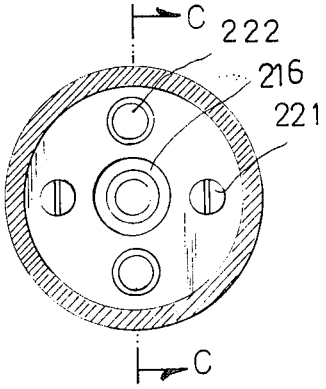
FIG. 4 is a cross-sectional view along line A—A in FIG. 3.

What follows is an account of the construction of a hinge in accordance with the present invention in terms of the interactions of all components covered hereunder against the illustrations as given in FIG. 2, FIG. 3, and in FIG. 4, FIG. 5, FIG. 6 as well; stress should be given to the transmission system as provided in cylinder 202, whereof the transmission lever 206 is complete with a square stem 212 on top to facilitate coupling into the sleeving 102, on the underside of the square stem 212 there is provided a washer ring 213 within which there is provided a bearing 228 that rests in the central concave ring 230 adjoined to screw 229, the bearing 228 is to be exposed slightly over the surface of the screw 229 and tightly adhered to washer ring 213 so as to reduce wearing resistances to the rotating transmission lever, on top of the transmission lever 206 there is provided a washer guidance 231 along the outer rim thereof, meant to accommodate disposition of a bumper 232, that section extending down the washer ring 213 from the transmission lever 206 is called stem 214, complete with two-way helical grooves 215 down under and a concentric stem 216 further down; the sleeving as related to above is complemented with a rubber oil-proofing ring 204 underneath the bumper 232 to restrict leakage of oil, the spring 207 as covered therein is being disposed between the oil-proofing ring 204 and the sliding block 208, the sliding block 208 to be set in the helical groove 215 as provided down the stem 214 of the transmission lever 206, so arranged that the sliding block 208 is complemented with both the inner and the outer pins 217, 218 respectively, the inner pin is to be engaged into the two-way helical groove 215 whereas the outer pin 218 is to be engaged to the interior groove guidance 219 as provided in the cylinder 202, the bottom of the sliding block 208 is also furnished with a little round hole 220, the sliding block 208 will have to be locked and bonded to piston 209 and fastened to security with screw 221. The said piston 209 is complete with two round holes 222 and the bottom of the sliding block 208 is also complete with two other round holes 223, the idea is that hole 222 must be exactly aligned with respect to hole 223 before sliding block 208 can be united to piston 209 to form up a circuitry of the hydraulic system, as can be perceived from a consultation of FIG. 4 and FIG. 6, the tip end of the adjusting bolt 211 as provided down the cylinder 202 is conically processed like a cup 224, the adjusting bolt 211 is meant to take control of the oil-proofing effects, that is, to regulate the output of the oils.

Figure 7:
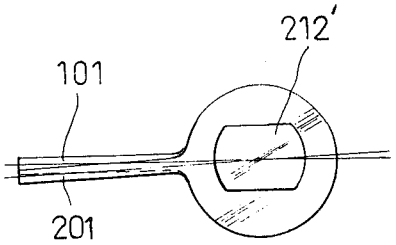
FIG. 7 is a top plan view of the combination of the dead tip of the elliptical rod on top of the transmission lever with the sleeving as covered by the invention.

The square stem 212 as formed as it is on top of the transmission lever 206 is compatible for another execution of the embodiment under the present invention by taking the shape of an elliptical stem 212', as shown in FIG. 7, the elliptical execution shall be processed to stand out at a slight deviation with respect to the length direction of the transmission lever 206, specifically that deviation shall be 5 degrees inclined inwardly, as demonstrated in FIG. 6, reference may be set up by taking the lengthwise direction of the level 206 as the ordinate axis. This deviation practice is intended to yield a forward push strain for a door provided hereunder that is being pulled back as an opening effort is ceased owing to the five degrees preserved for offsetting a rotation of the transmission lever 206 so as to bring the door to a tightly secured closure, the only deviation is that existing in the rotation angle of the transmission lever and the backpull tension of the spring, all other mechanism remain substantially unchanged.

Next given is an account of the installation and the operations of the present invention; the interior mechanism of the cylinder 20 is put in order for fitting onto the door frame, the sleeving jacket 10 to be fitted onto the door in order, to assemble the unit, the port 102' of the sleeving jacket 10 is aligned with the square stem 212 of the transmission lever 206 of the cylinder 20 whereupon the cylinder 20 is fixed onto the door frame by means of the fix plate 201, the cylinder 202, however, will stand at a fixed perpendicular position, thus, coupling assemblage of the door fitted with sleeving 10 is quite easy, when the door is to be pushed to open, the fact that the sleeving as fitted to the door will carry the transmission lever 206 of the cylinder 202 as fitted to the door frame to rotation will serve to lift up the sliding block 208 of the cylinder 202 thereby presenting pressure against the spring 207, to the effect that the lubricant oils as stored in the cylinder 202 will be set to converge to thrust upwards, experiments taken by the inventor of the opening of the doors structured hereunder give the result that should a door be pushed to open to a position short of 85 degrees, then the door would be able to recover back to original closure position without failure, that the door can be swivelled to open to 85 degrees is closely related to the two-way helical grooves 215 as provided in the transmission lever 206, as the door is turned to open the sliding block 208 will become uplifted due to the rotation of the transmission lever 206, that is, the sliding block 208 will perform up-and-down movements only because the outer pin thereof are caught in the groove 219 on the inner side of the cylinder 202, as the condition turns to such that the sliding block 208 ascends to the top 225 of the two-way helical groove 215, the door will hold still at exactly the 85 degrees opening point, to reset the door to closure this 85 degrees opening point will have to be pulled off by the stretching effects of the compressed spring 207 to bring the sliding block 208 to displace downwards, whereupon the transmission lever 206 will be forced to follow in rotation as well till the door is reset back again to exactly the closure position, it is worth mentioning that upon completion of the installation of the present invention titled an improved structure of automatic hinge to a given door, the angle of rotation to set the door to open can be extended to as large as 170 degrees, but that the position coverage from 85 degrees to 170 degrees corresponds to the idle rotation position of the transmission lever 206, wherein no transmission drive is available.

The opening and closing movements as described above of the door in question are characterized in that while the door is pushed to open, the hydraulic system as provided in the cylinder 202 will serve to give a damping efforts to the door to avoid abrupt resetting actions of the door and lend a slow but sure resetting for the door instead, hydraulic effects are derived from the cylinder 202 that is filled up with oil fluids, that is, as the door is being pushed to open, the sliding block 208 together with the piston 209 will lift up concurrently to produce a condition wherein the oil mass are forced to move upwards, at the same time part of the oil will be leaked out via the two round holes 222 on the piston 209 on the one hand, and part of the oil will leak out via the small round hole 226 as provided on the round stem 214 of the transmission lever 206 on the other hand, now as an aperture 227, as covered in FIG. 3, is reserved underneath the conical tip 224 of the adjusting bolt 211 and the little round stem 216 of the transmission lever 206, the aperture port 227 is permissible for adjustment with the adjusting bolt 211 to control the amount of oil to pass through, specifically, oil will be partially leaked out via aperture port 227 as the sliding block 208 is in the action of going upwards, and importantly, return by way of the same aperture port 227 as the sliding block 208 slides down as the door is in the action of being recovered back to closure, moreover, a space 233 is reserved between the outmost end of the transmission lever 206 and the adjusting bolt 211, to serve the purpose that no obstruction or hindrances will stand in the way of the passage of the oil, incoming or outgoing, the hydraulic system is of the continuous recycling type, its chief function is to avoid collision of the door due to abrupt displacement in the course of returning to closure, but help to ensure a slow but sure resetting of the door instead.

The mechanical device and the transmission system incorporated thereto as covered by the present invention is the best embodiment of all the hinge sets contrived by the inventor for study and trial experimentations over a couple of years, all of its components can be produced by extrusion processing with moulds thus minimizing labour costs, the construction is simple enough to be complete with hydraulic system to produce transmissions required to set the device to work, it is therefore considered a truly ideal and economical piece of invention worthy to be recommended for application.

I claim:

1. A self-resetting, automatic hinge, comprising: a sleeving compartment complete with a sleeving and a fix plate annexed thereto, the sleeving having a square entry port, a cylinder column, complete with a hollow cylinder and a fix plate annexed thereto and a longitudinal guidance groove on an internal surface thereof, serving to set in transmission elements including:

a transmission lever, a top of said lever having a substantially square stem, with an annular washer provided underneath the substantially square stem and bearing further down, the bearing being engaged into a concave ring provided in a middle of a screw collar provided on the transmission lever in a manner to project a little over the surface of the screw collar and to adhere tightly to the bottom of the annular washer so as to serve to avoid frictional drag on the transmission lever in rotation, on top of the transmission lever there is furthermore provided a ring groove alongside an outer rim thereof, to be reinforced by facilitating holding thereof by the sleeve of a bumper to be provided otherwise, an underside of an annular ring being formed into a round stem with a two-way helical groove provided over an outer surface above the bottom of said round stem, an extension thereof being executed into a smaller concentric stem, a middle portion of the round stem that is part of the transmission lever being furnished with a small round hole that serves to provide for a passage along the hollow interior of the transmission lever;

a sliding sleeve, complete with one set of inner and outer pins projecting from an internal surface and outer surface thereof respectively, the bottom of said sliding sleeve is further provided with a round hole and two relatively smaller holes; the sliding sleeve being incorporated to the transmission lever complete with inner pins for sliding coupling to a two-way helical groove whereas an outer pin is to be engaged to the guidance groove provided on the inner surface of the cylinder, such that the round hole at the bottom of the sliding sleeve will allow penetration thereinto by a smaller round stem provided on the transmission lever;

a piston, attached to the bottom of the sliding sleeve and having a round hole and two relatively smaller holes of the same dimension as those provided at the bottom of the sliding sleeve aligned therewith being fastened with screws;

an oil-proofing ring, made of rubber and bonded with an iron piece underneath, to be secured to the position of the round stem as provided below the substantially square stem provided as a part of the transmission lever to enhance security from displacement;

a spring, disposed around the transmission lever and lying between the oil-proofing ring and the sliding sleeve; and a threaded adjusting bolt, a tip of which is conical, serving to adjust and restrict an aperture port provided at the terminal end of the transmission lever.

2. A self-resetting hinge according to claim 1 in which, as the sleeving compartment as united to a door provided hereunder is rotated to open, the sliding block as provided in the cylinder as fitted to the door frame will lift upwards as a result of the joint rotation of the transmission lever to bring pressure to bear on the spring, and that an automatic self-resetting of the door is realized inasmuch as the door, due to rotation of the transmission lever, is pushed open to a position short of 85 degrees from a closed position.

3. A self-resetting hinge according to claim 2, in which the door provided therewith can be opened beyond the 85 degrees from the closed position to reach a position that is 170 degrees from the closed-position as it is pushed open, the coverage between 85 degrees and 170 degrees corresponding to an upper guidance groove extending from the two-way helical groove provided in the transmission lever, whereby the transmission lever is in an idle running situation.

4. A self-resetting hinge according to claim 1, in which once the door is pushed open to a position beyond 85 degrees from a closed position, the inner pin of the sliding sleeve would be brought into a guidance groove on top of the two-way helical groove that is provided on the transmission lever and the door will come to a halt accordingly, that the automatic recovery of the door can be expected only after manual efforts have been exerted to pull the door back to within the 85 degrees from the closed position.

5. A self-resetting hinge according to claim 1, in which a little clearance is maintained from the terminal end of the smaller stem down the transmission lever to screws provided therefore as said smaller stem is being fitted, in order that access through the oil passage hole as provided at the terminal end of the little round hole, as by the oil that constitutes in part the hydraulic system thereof, will be all the more aptly done.

6. A self-resetting hinge according to claim 1 in which a door provided therewith may be pushed open or drawn to a closed position due to the rotation of the transmission lever provided therewith to bring the spring to a compressed state, and when the spring is released the sliding sleeve is displaced downwards, in the meantime cause the transmission lever to rotate in an opposite direction to reset the door closure, and in that a hydraulic system installed in the cylinder section assures a slow but sure closure of the door.

7. A self-resetting hinge according to claim 1, in which the stem has two opposite rounded sides.

* * * * *